United States Patent [19]

Taub

[11] 4,306,366

[45] Dec. 22, 1981

[54] DISPLAY CARD WITH MOVABLE EXTENDING MEMBER

[75] Inventor: Ronald H. Taub, Highland Park, Ill.

[73] Assignee: Taub Family Trust U/A

[21] Appl. No.: 116,148

[22] Filed: Jan. 28, 1980

[51] Int. Cl.[3] ..... G09F 3/18

[52] U.S. Cl. ..... 40/16; 40/124.1; 40/584

[58] Field of Search ..... 40/16, 124.1, 584

[56] References Cited

U.S. PATENT DOCUMENTS

| | | | |
|---|---|---|---|
| 2,297,888 | 10/1942 | Heileman | 40/16 |
| 2,720,044 | 10/1955 | Montalto | 40/16 |
| 3,423,860 | 1/1969 | Berry et al. | 40/16 |
| 4,167,073 | 9/1979 | Tang | 40/584 X |

*Primary Examiner*—Gene Mancene
*Assistant Examiner*—Wenceslao J. Contreras
*Attorney, Agent, or Firm*—Kegan, Kegan & Berkman

[57] ABSTRACT

A card for displaying price or other graphic information is mountable on a price rail of a conventional store display shelf, stand, or the like, and includes a central information carrying portion, and opposed tabs extending therefrom which are adapted to be retained in a conventional price rail. One of the tabs includes a remote enlarged portion suitable for containing information thereon and connected to that tab by a rib or a bridging portion which extends from an edge of that tab which is not retained by the price rail when the card is mounted therein.

4 Claims, 4 Drawing Figures

DISPLAY CARD WITH MOVABLE EXTENDING MEMBER

BACKGROUND OF THE INVENTION

This invention relates to a display card, conventionally containing article pricing information thereon, which is mountable on a price rail of a store display case, grocer's shelf, dairy case, display stand, or the like.

Heretofore, shelf pricing displays have included dangling "attention getting" portions which extend from or are joined to the bottom edge of such a device. Such an arrangement is shown in U.S. Pat. No. 3,774,328, issued Nov. 27, 1973, to Mr. O. Tanney. Unfortunately, in this arrangement the shape of the individual pricing rail portion on which a support portion or header of the device is mounted may control, or at least provide undesirable input to, the curvilinear shape of a rib or other bridging portion between the header and dangling portion.

BRIEF SUMMARY OF THE INVENTION

The invention is directed to a display card which is adapted for being secured on a display stand or the like. The display card includes a central portion which is suitable for having information, such as pricing information, positioned thereon. Extending from opposing sides of the central portion are first and second mounting tabs. The first tab includes a pair of opposed parallel edges which are adapted for securement on a retainer of a display stand. The second tab includes at least one edge which is colinear with one of the parallel edges on the first tab. That one edge also provides for securement of the display card by a retainer on a display stand. An enlarged remote portion of the card, also suitable for having information such as pricing information positioned thereon, is connected with the second tab by means of an integral resilient rib or bridging portion which extends from an edge of the second tab other than the one edge thereof. The bridging portion maintains the remote portion out of the general plane defined by the central portion and the first and second tabs of the display card as mounted on a display stand.

It is therefore a general object of the invention to provide an improved card for displaying consumer information on a store display shelf or the like.

Another object of the invention is the provision of a display card having a remote information carrying portion which resiliently and movably extends from the portion of the display card retained on the display stand in an improved manner not heretofore known.

BRIEF DESCRIPTION OF THE DRAWINGS

These and other objects of the present invention will be apparent from the following detailed description of a preferred embodiment, taken in conjunction with the accompanying drawings, wherein.

DETAILED DESCRIPTION OF THE PREFERRED EMBODIMENT

Figure 1:
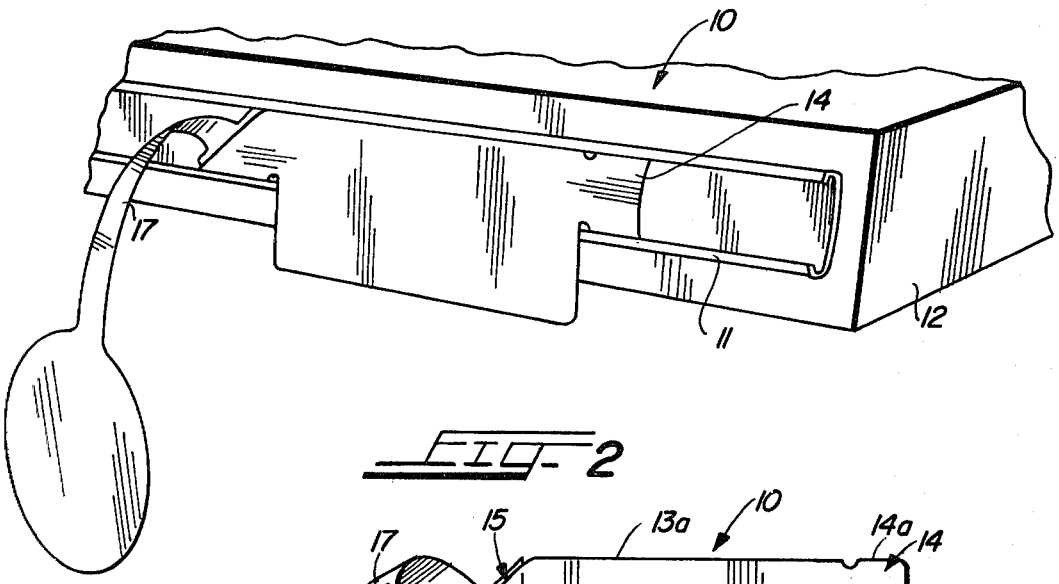
FIG. 1: A perspective view of an improved display card constructed in accordance with the invention as shown mounted on a conventional display stand pricing rail.
Figure 2:
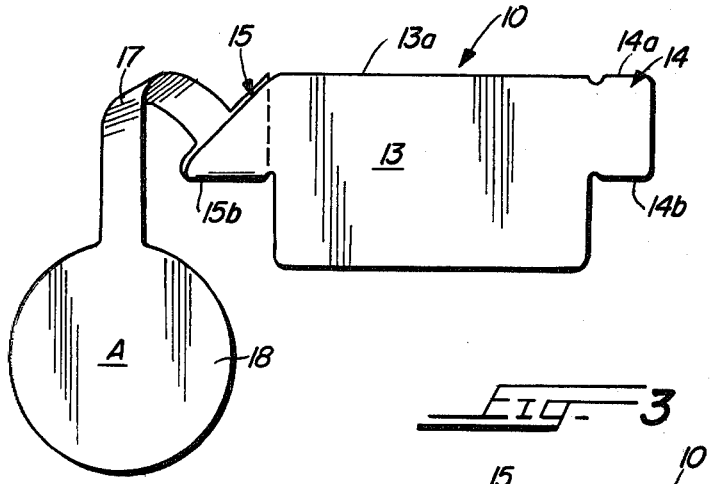
FIG. 2: A detailed side elevational view of the display card shown in FIG. 1.
Figure 3:
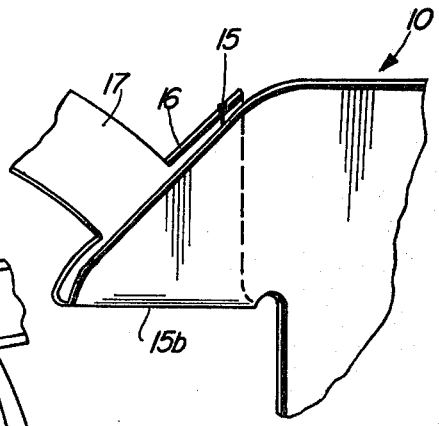
FIG. 3: A fragmentary detailed view of the display card tab from which the remote portion extends.

Referring to FIGS. 1–3, a preferred embodiment of a display card constructed in accordance with the present invention is generally indicated at 10 as it appears when mounted in a conventional price rail 11 which in turn is secured to a leading edge of a conventional shelf 12 of a store display stand (not shown), or the like. As shown most clearly in FIG. 2, the display card 10 includes an enlarged generally rectangular central portion 13 having a first tabular portion 14 extending from the right hand side thereof, and a second tabular portion 15 extending from the left hand side thereof. Right hand tab 14 includes opposed parallel edges **14*a* and 14*b* which define the height of tab 14 such that, as shown most clearly in FIG. 1, it may be retained in a price rail 11**.

Referring to FIG. 3, in this embodiment the lefthand tab 15 includes a doubled or back-folded portion 16 which is creased along tab edge **15*b*. As shown most clearly in FIG. 2, edge 15*b* is co-linear with and serves the same function as right-hand tab edge 14*b*, that is, to retain the tab 15 inside the price rail 11**.

A rib or bridging portion 17 extends from the back-folded portion 16 of left-hand tab 15 and terminates at an enlarged remote portion 18. In this embodiment remote portion 18 is circular in shape and also capable of carrying information thereon. As shown most clearly in FIG. 3, both the front portion and back-folded portion 16 of tab 15 are triangular in shape and the rib 17 extends from the longest side, the acutely, angularly oriented side of the back-folded portion.

In operation, the display card 10 is folded along line **15*b* in order to double the thickness of the tab 15 and to orient the rib 17 such that it extends upwardly and outwardly from the remainder of the display card. The weight of the enlarged remote portion 18 causes the rib 17 to bend downwardly between its ends such that the outwardly exposed face A of remote portion 18 is the same side of display card 10 as the outwardly facing surface B of central portion 13 (FIG. 2). This configuration assures that printing for both the remote portion 18** and central portion may be performed on the same side of the display card, and eliminates the necessity of more than one printing operation thereon.

In this embodiment, the display card 10 is inserted in price rail 11 by bowing the tabular portion 14 and a combination of the top edge **13*a* of central portion 13 and the folded edge 15*b* of left tab 15 such that those edges may be retained against the interior of the price rail 11. While the central portion 13 in this embodiment is shown as an enlarged rectangle, it may be understood that central portion may be a continuation of the tabs 14–15**, or be larger or smaller than the tabs depending upon the amount of information, if any, desired to be placed thereon.

Figure 4:
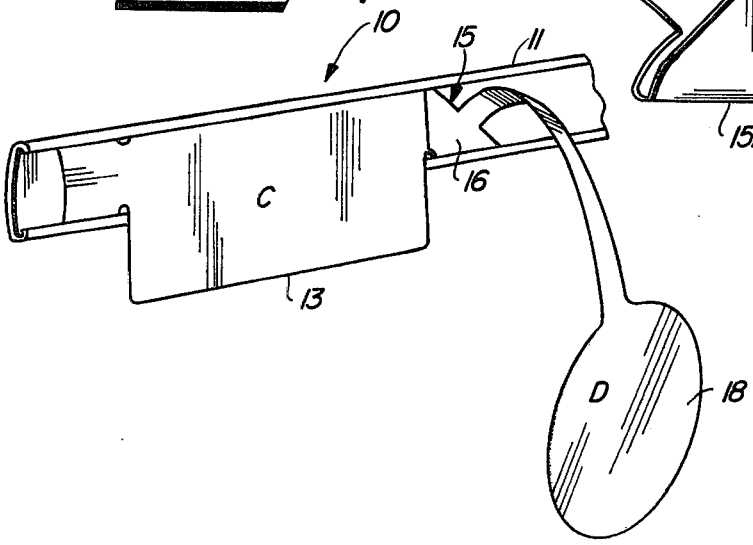
FIG. 4: A perspective view similar to that shown in FIG. 1 wherein the display card of the present invention is mounted reversely from that shown in FIG. 1.

As shown most clearly in FIGS. 1 and 4, by extending bridging portion 17 from tab 15 at an acute angle with bottom edge **15*b*, an asymetrical support is formed, i.e., any axis on portion 18 is skewed with any axis of portions 13, 14 or 15. As a result, remote portion 18** is more susceptible to movement from localized air tubulence present in a typical store aisle than heretofore known remote display card portions.

Referring to FIG. 4, the display card 10 of the invention is shown mounted in the price rail 11 in inverted position to that shown in FIG. 1 such that the triangular shape of the back-folded portion 16 of tab 15 takes on the appearance of an arrow pointing from the remote portion 18 to the enlarged central portion 13 of the display card. It should be noted that both the exposed side surfaces C of central portion 13 and D of remote portion 18 are on the same side of display card 10 and may each contain printing or other information placed thereon, similarly to the mounted positions of the display card 10 shown in FIG. 1, but being the opposing side of the card.

While one particular embodiment of the invention has been shown and described, it will be obvious to those skilled in the art that changes and modifications may be made without departing from the invention in its broader aspects. Therefore, the aim in the inpendent claim is to cover all such changes and modifications as fall within the true spirit and scope of the invention.

What is claimed is:

1. A display card adapted for securement on a display stand or the like, said card comprising:

a central portion suitable for having information positioned thereon;

first and second mounting tabs being opposing portions of the perimeter of said central portion, said first tab including a pair of opposed parallel edges adapted to be secured by a retainer on a display stand, said second tab including at least one edge being co-linear with one of said parallel edges on said first tab for securement by a retainer on a display stand and a doubled portion backfolded along said one edge for strengthening same; and a remote portion suitable for having information positioned thereon, said remote portion being connected with said second tab by an integral resilient bridging portion or rib therebetween, and said bridging portion extending from an edge on said doubled portion of said second tab other than said one edge thereof for maintaining said remote portion out of a plane generally defined by said central portion and said first and second tabs when retained on a display stand.

2. The display card as defined in claim 1 wherein said one edge of said second tab is a bottom edge thereof as mounted in a display stand.

3. The display card as defined in claim 6 wherein at least a portion of the periphery of said central portion is adapted to be retained by a retainer on a display stand, and said portion of said periphery co-acts with said one edge of said second tab for securing said second tab in a retainer on a display stand.

4. The display card as defined in claim 1 wherein a line of intersection of the plane of said remote portion and the plane of said central portion is other than parallel with said one edge.

* * * * *

UNITED STATES PATENT OFFICE

CERTIFICATE OF CORRECTION

Patent No. 4,306,366 Dated December 22, 1980

Inventor(s) Ronald H. Taub

It is certified that error appears in the above-identified patent and that said Letters Patent are hereby corrected as shown below:

At column 4, line 19, delete -- 6 -- and insert "1" in its place.

Signed and Sealed this

Sixth Day of April 1982

[SEAL]

Attest:

GERALD J. MOSSINGHOFF

Attesting Officer

Commissioner of Patents and Trademarks